US011336037B1

(12) United States Patent
Wu

(10) Patent No.: US 11,336,037 B1
(45) Date of Patent: May 17, 2022

(54) TERMINAL BLOCK STRUCTURE

(71) Applicants: DINKLE ENTERPRISE CO., LTD., New Taipei (TW); DINKLE ELECTRIC MACHINERY (CHINA) CO., LTD., Jiangsu (CN); LI YANG ELECTRIC MACHINERY (DONGGUAN) CO., LTD., Dong Guan (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN); LI YANG ELECTRIC MACHINERY (DONGGUAN) CO., LTD., Dong Guan (CN)

( * ) Notice: Subject to any disclaimer, the term of this patent is extended or adjusted under 35 U.S.C. 154(b) by 0 days.

(21) Appl. No.: 17/137,344

(22) Filed: Dec. 29, 2020

(51) Int. Cl.
*H01R 4/48* (2006.01)
*H01R 9/22* (2006.01)
*H01R 9/24* (2006.01)

(52) U.S. Cl.
CPC ..... *H01R 4/4836* (2013.01); *H01R 9/223* (2013.01); *H01R 9/2408* (2013.01)

(58) Field of Classification Search
CPC .... H01R 4/4836; H01R 9/223; H01R 9/2408; H01R 4/4827
USPC ..... 439/729
See application file for complete search history.

(56) References Cited

U.S. PATENT DOCUMENTS 10,658,770 B1 5/2020 Wu
2004/0102078 A1* 5/2004 Miyoshi ..... H01R 4/4836 439/387
2021/0288416 A1* 9/2021 Witte ..... H01R 4/4836

FOREIGN PATENT DOCUMENTS

DE 202020105218 U1 12/2020

OTHER PUBLICATIONS

Search report dated Jun. 7, 2021 of the corresponding European patent application No. 21150438.6.

* cited by examiner

*Primary Examiner* — Renee S Luebke
*Assistant Examiner* — Paul D Baillargeon
(74) *Attorney, Agent, or Firm* — Chun-Ming Shih; HDLS IPR Services

(57) ABSTRACT

The invention relates to a terminal block structure includes an insulative base, a conductive terminal, a pressing element, and a clamping elastic piece. The insulative base has a chamber, a wire insertion hole and an open trough disposed on the same side of the insulative base as the wire insertion hole. The conductive terminal is fixed in the chamber and arranged correspondingly to the wire insertion hole. The pressing element includes a pivoting portion, an arm, a handle, and a pressing portion. The pivoting portion is pivotally connected to the insulative base. The arm protrudes from the insulative base through the open trough. The handle is movable beside the wire insertion hole. The clamping elastic piece is disposed in the chamber. An end of the clamping elastic piece is operatively moved to inside or outside of the wire insertion hole through the pressing portion.

10 Claims, 11 Drawing Sheets

TERMINAL BLOCK STRUCTURE

BACKGROUND OF THE INVENTION

Technical Field

The invention relates to a terminal block structure, particularly relates to a terminal block structure that may save operating space.

Related Art

Terminal block structures are widely applied in machine equipment (such as industrial computers, uninterruptible power systems, power supplies, etc.), industrial control equipment (such as electromechanical systems, refrigeration and air conditioning, programmable controllers, etc.) or household appliances (such as air conditioners, refrigerators, washing machines, ovens, etc.) to serve as an electric connection device for multiple wires.

A terminal block structure is composed of an insulative base and a conductive terminal. The insulative base is provided with an elastic sheet for fixing a wire. By means of the elastic sheet being pressed by a pressing element assembly, a wire can be inserted into the insulative base to make electric connection with the conductive terminal. The wire can be pressed by the elastic sheet and positioned in the insulative base by pressing the wire with the elastic sheet.

However, the terminal block structure has a drawback. Because the pressing element assembly is formed at a side position of the insulative base, the pressing element assembly occupies considerable operating space when it is operated.

In view of this, the inventors have devoted themselves to the above-mentioned terminal block structure, researched intensively and cooperated with the application of science to try to solve the above-mentioned problems. Finally, the invention which is reasonable and effective to overcome the above drawbacks is provided.

SUMMARY OF THE INVENTION

An object of the invention is to provide a terminal block structure that may save operating space. The terminal block structure may effectively save the operating space of the handle in operation by the arrangement of the wire insertion hole and the handle.

To accomplish the above object, the invention provides a terminal block structure includes an insulative base, a conductive terminal, a pressing element, and a clamping elastic piece. The insulative base has a chamber, a wire insertion hole communicating with the chamber and an open trough disposed on the same side of the insulative base as the wire insertion hole. The conductive terminal is fixed in the chamber and arranged correspondingly to the wire insertion hole. The pressing element includes a pivoting portion, an arm, and a handle. The pivoting portion is pivotally connected to the insulative base. The arm protrudes from the insulative base through the open trough. The handle is disposed on outside of the insulative base. The handle is movable beside the wire insertion hole. The pressing element further includes a pressing portion. The clamping elastic piece is disposed in the chamber. An end of the clamping elastic piece is operatively moved to inside or outside of the wire insertion hole through the pressing portion.

The invention further has following advantages. Because the entire structure is compact, more terminal block structures may be installed in the same volume to effectively reduce costs of installation and use.

DETAILED DESCRIPTION OF THE INVENTION

To further disclose the features and technical contents of the invention, please refer to the following description and the drawings. However, the drawings are used for reference and description only, not for limitation to the invention.

Figure 1:
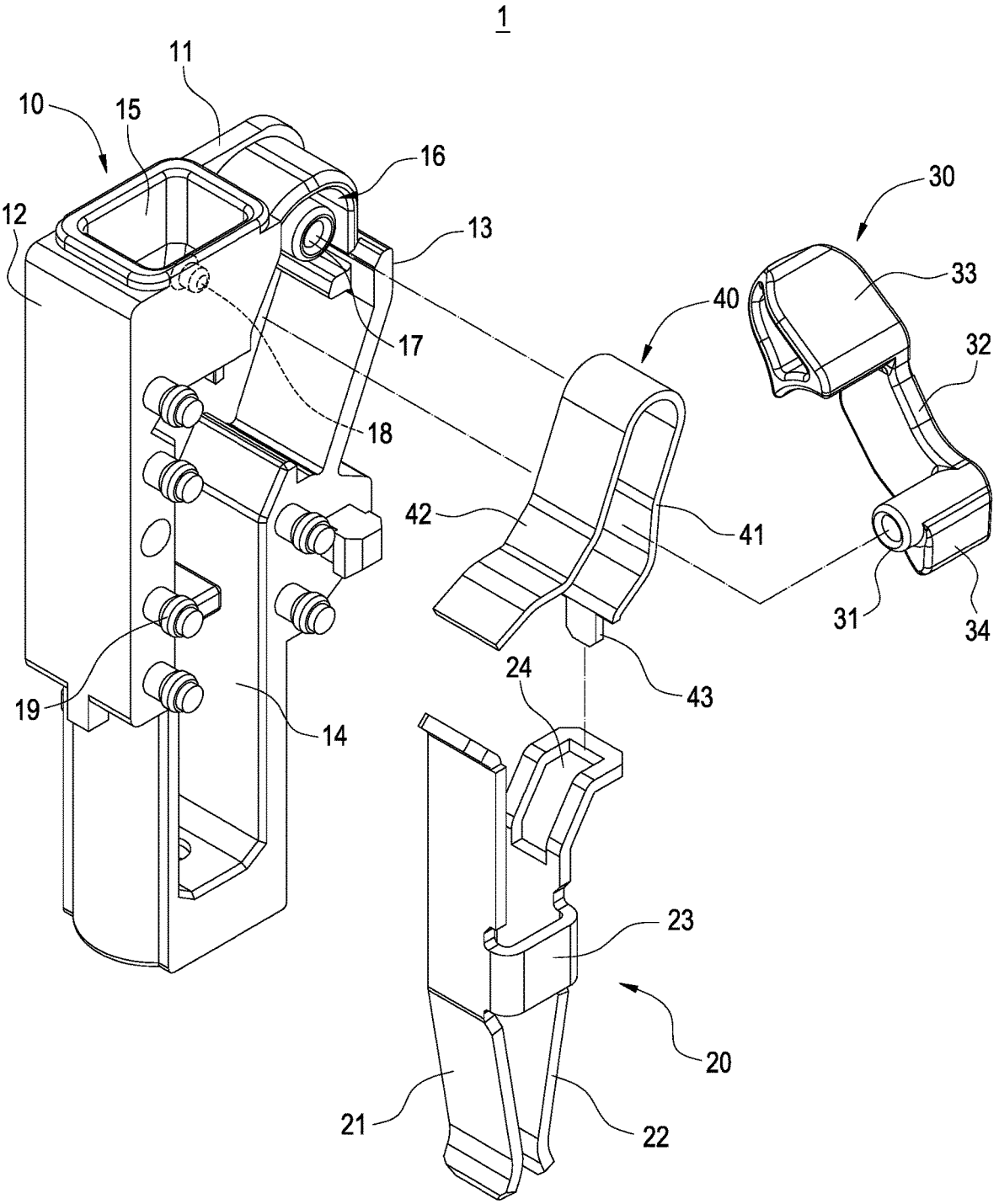
FIG. 1 is an exploded view of the terminal block structure of the invention.
Figure 2:
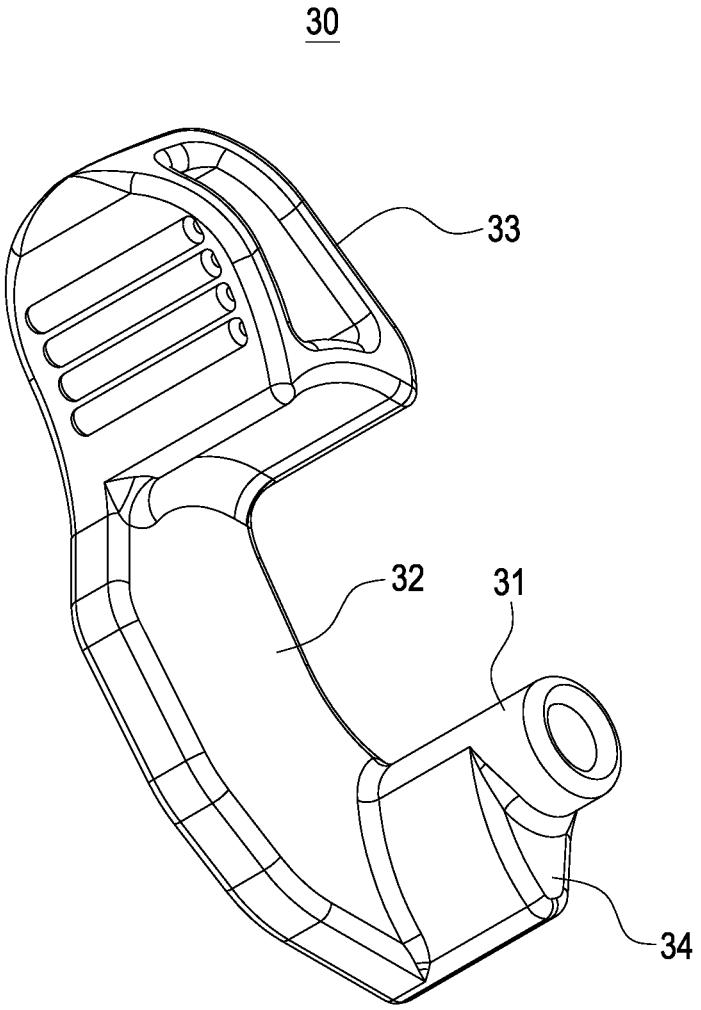
FIG. 2 is an exploded view of the pressing element of the invention.
Figure 3:
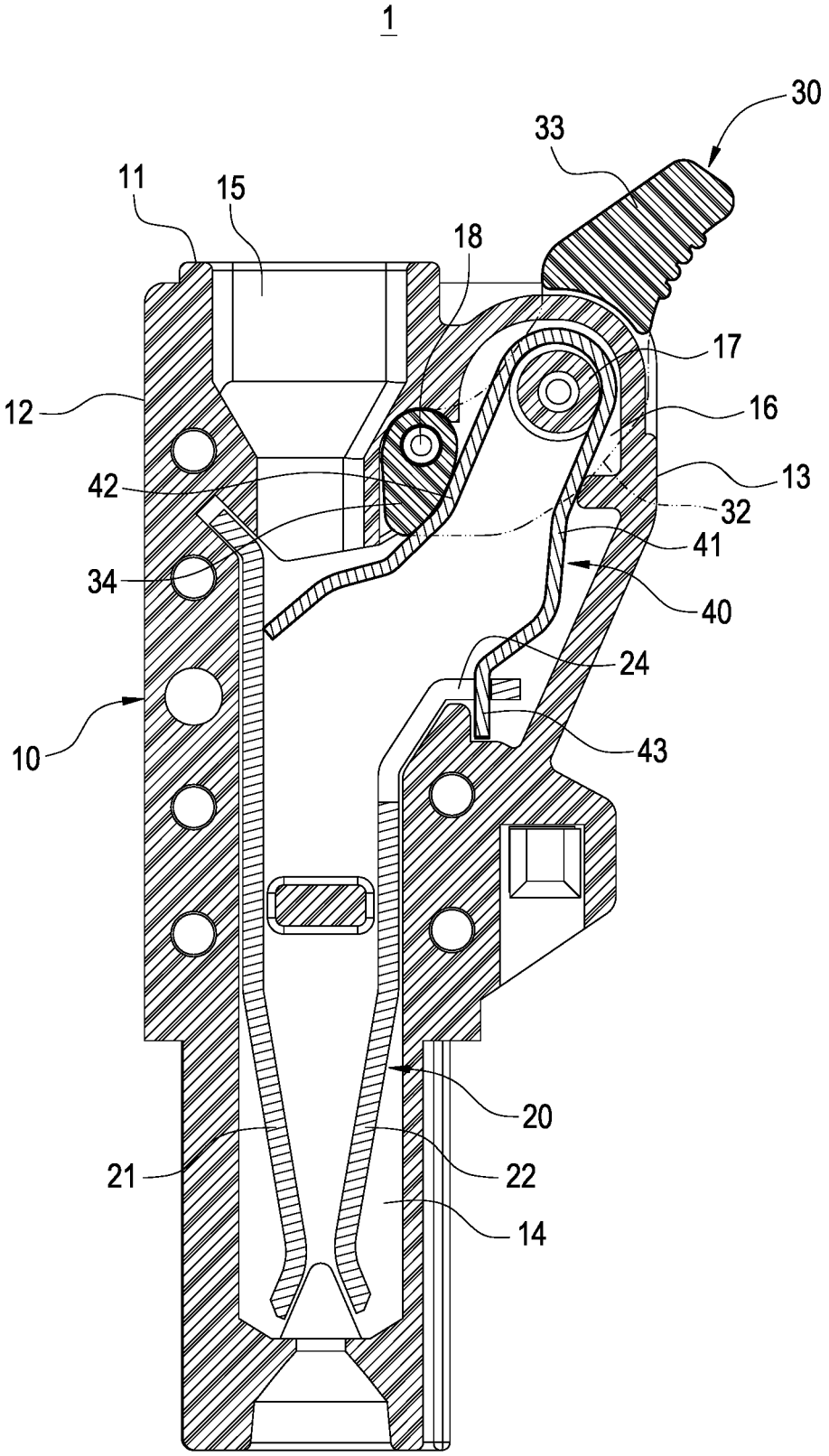
FIG. 3 is a cross-section view of the terminal block structure of the invention.

Please refer to FIGS. 1-3. The invention provides a terminal block structure 1 that may save operating space. The terminal block structure 1 includes an insulative base 10, a conductive terminal 20, a pressing element 30 and a clamping elastic piece 40.

The insulative base 10 has a first side 11, a second side 12 and a third side 13. The second side 12 and the third side 13 are connected to two ends of the first side 11 and are parallel to each other. The second side 12 and the third side 13 are perpendicular to the first side 11. The insulative base 1 has a chamber 14, a wire insertion hole 15 and an open trough 16. The wire insertion hole 15 is located at the left of the first side 11 and communicates with the chamber 14. The open trough 16 is disposed on the right of the first side 11. Partial area of the open trough 16 is disposed to an upper portion of the third side 13.

Furthermore, the chamber 14 of the insulative base 10 is provided with a pillar 17 and a pivot 18. An edge surface of the insulative base 10 is protruded with multiple fixing bars 19. The conductive terminal 20 is made of a material with relatively good conductivity, such as copper or an alloy thereof. The conductive terminal 20 is fixed in the chamber 14 and arranged correspondingly to the lower position of the wire insertion hole 15. The conductive terminal 20 includes a first conductive sheet 21, a second conductive sheet 22 arranged spacedly with the first conductive sheet 21 and a connecting sheet 23 connected with the first conductive sheet 21 and the second conductive sheet 22. A slot 24 is disposed on the top of the second conductive sheet 22.

The pressing element (such as a lever, a trigger) 30 includes a pivoting portion 31, an arm 32 extending from the pivoting portion 31 and a handle 33 extending from the arm 32. In this embodiment, the pivoting portion 31 is a shaft sleeve inserted by the pivot 18 (or the pivot 18 is socketed by the pivoting portion 31) so as to make the pressing element 30 rotatable against the insulative base 10. The arm 32 protrudes from the insulative base 10 through the open trough 16. The handle 33 is formed on outside of the insulated base 10. With the pivotal connection of the pivoting portion 31 and the pivot 18 and the pressing to the handle 33, the handle 33 may be movable beside the wire insertion hole 15.

Furthermore, the pressing element 30 includes a pressing portion 34. In this embodiment, the pressing portion 34 extends from the pivoting portion 31 toward a direction away from the arm 32. The pressing portion 34 is substantially a triangular prism in shape.

The clamping elastic piece 40 is made of a material with relatively good conductivity, such as copper or an alloy thereof. The clamping elastic piece 40 is disposed in the chamber 14 at a position corresponding to the pillar 17. The clamping elastic piece 40 includes a fixed section 41 and a moving section 42 extending from the fixed section 41. A clipping piece 43 is extended from a front end of the fixed section 41. The clipping piece 43 is used to insert into and connect fixedly with the slot 24. The fixed portion 41 is fixed between the pillar 17 and a wall of the insulative base 10. The moving section 42 extends from the pillar 17 to abut against a periphery of the pressing portion 34. The moving section 42 reaches a position under the wire insertion hole 15 to abut against the first conductive sheet 21.

Figure 4:
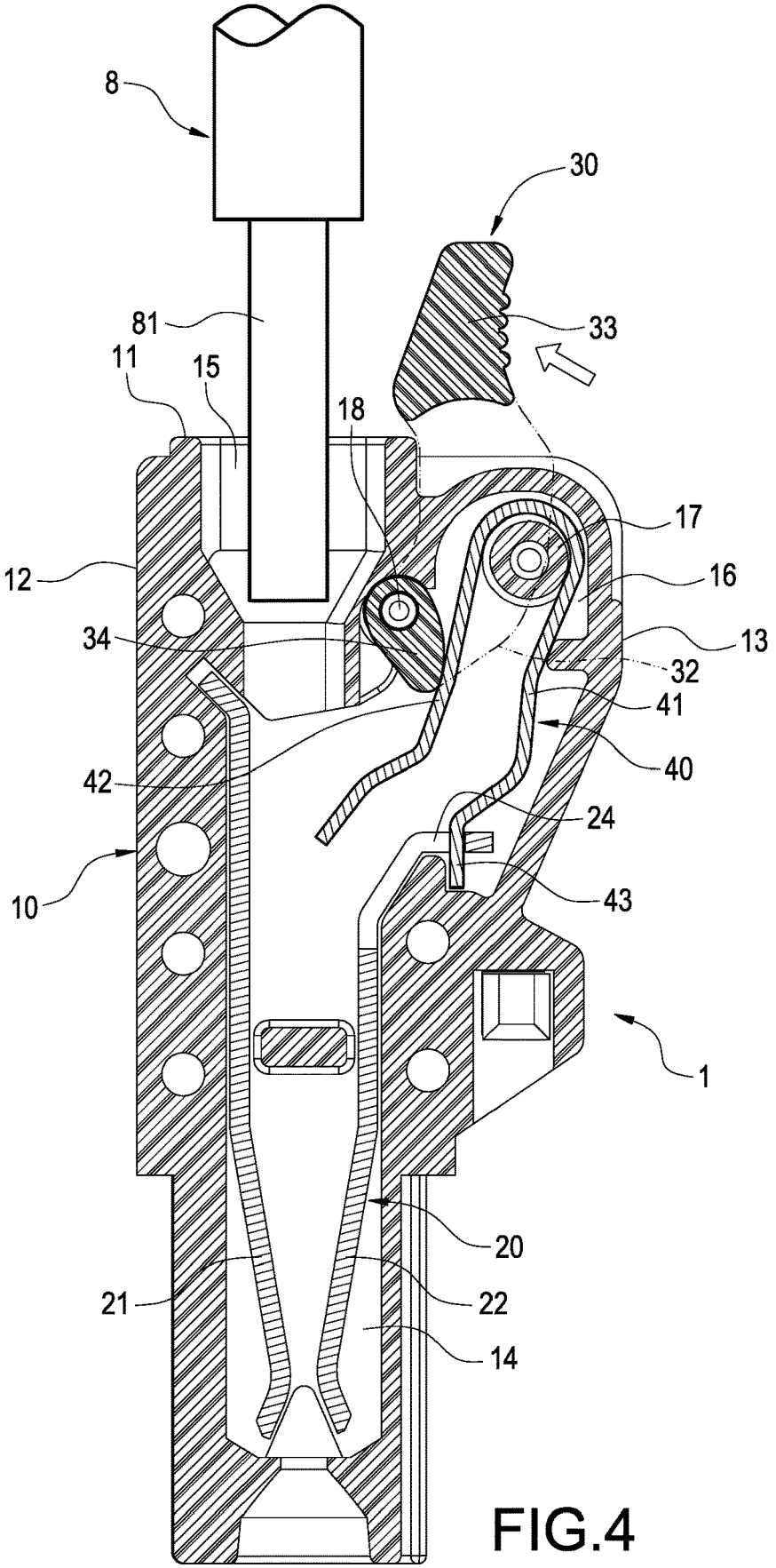
FIG. 4 is a schematic cross-section view of use status of the terminal block structure of the invention and a wire.
Figure 5:
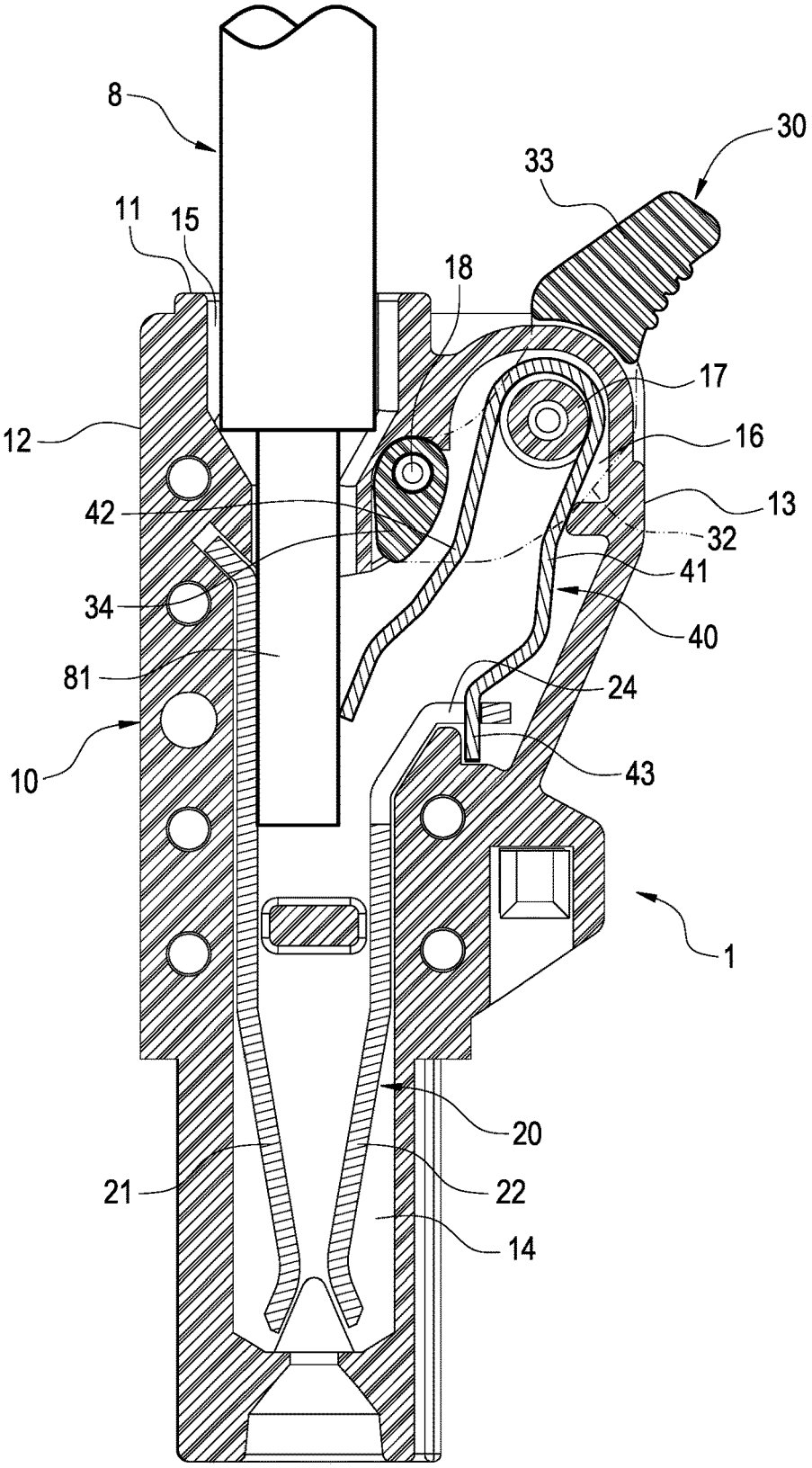
FIG. 5 is another schematic cross-section view of use status of the terminal block structure of the invention and a wire.

Please refer to FIGS. 4 and 5. A wire 8 may be inserted to the terminal block structure 1 of the invention for connection. The wire 8 has a core line 81. When the handle 33 is pressed toward the wire insertion hole 15 during usage, the pressing portion 34 presses the moving section 42 of the clamping elastic piece 40 to move away from the wire insertion hole 15. At this time, the wire 8 may be inserted into the wire insertion hole 15, and the handle 33 is pressed in a direction away from the wire insertion hole 15. The pressing portion 34 releases the moving section 42 of the clamping elastic piece 40. The moving section 42 and the first conductive sheet 21 jointly clamp the core line 81 through the elastic restoring force of the moving section 42. Because the action range of the handle 33 is between the third side 13 and the wire 8, the operating space of the handle 33 may be effectively saved.

Figure 6:
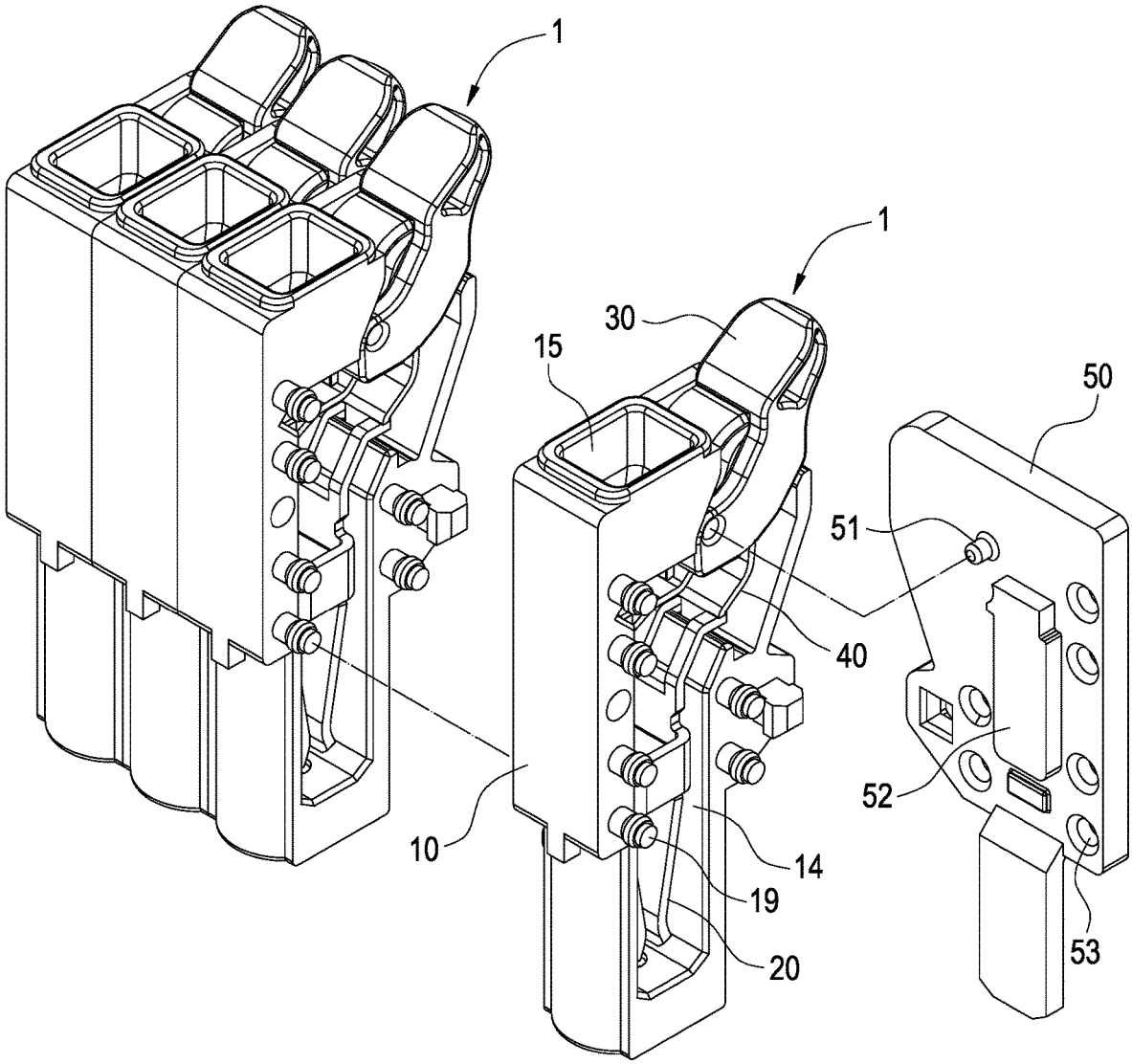
FIG. 6 is a schematic view of multiple terminal block structures of the invention.
Figure 7:
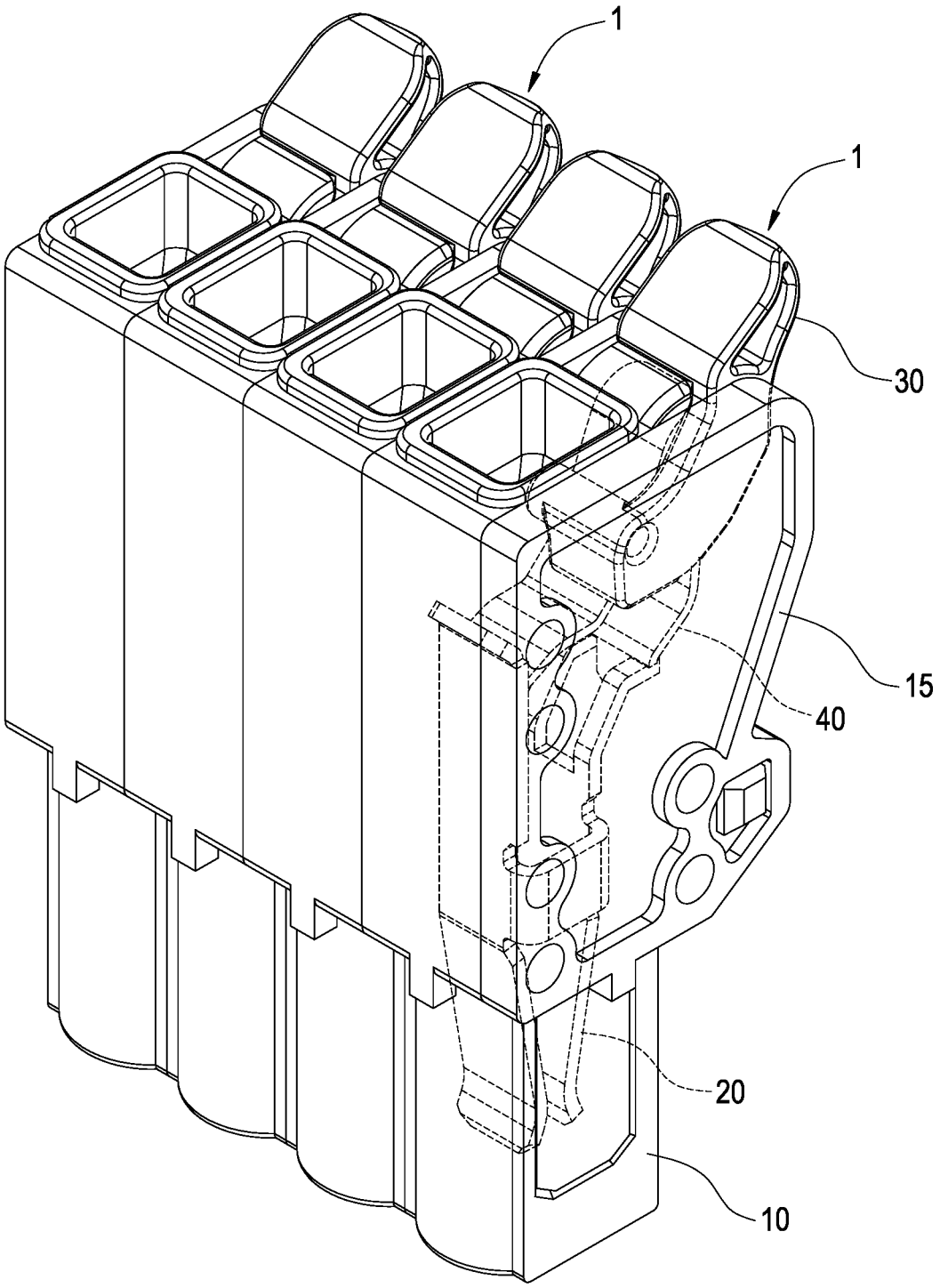
FIG. 7 is an assembled view of multiple terminal block structures of the invention.

Please refer to FIGS. 6 and 7. The terminal block structure 1 of the invention further includes a cover 50 for covering a side of the insulative base 10. The cover 50 includes a shaft 51, a pressing block 52 and multiple through holes 53. The shaft 51 is inserted correspondingly into the pivoting portion 31. The pressing block 52 is pressed to the connecting sheet 23. Each of the through holes 53 is correspondingly inserted by and fixed with the fixing bars 19. The terminal block structure 1 of the invention may be stacked with another terminal block structure 1 or multiple terminal block structures 1 to form a terminal block assembly structure.

Figure 8:
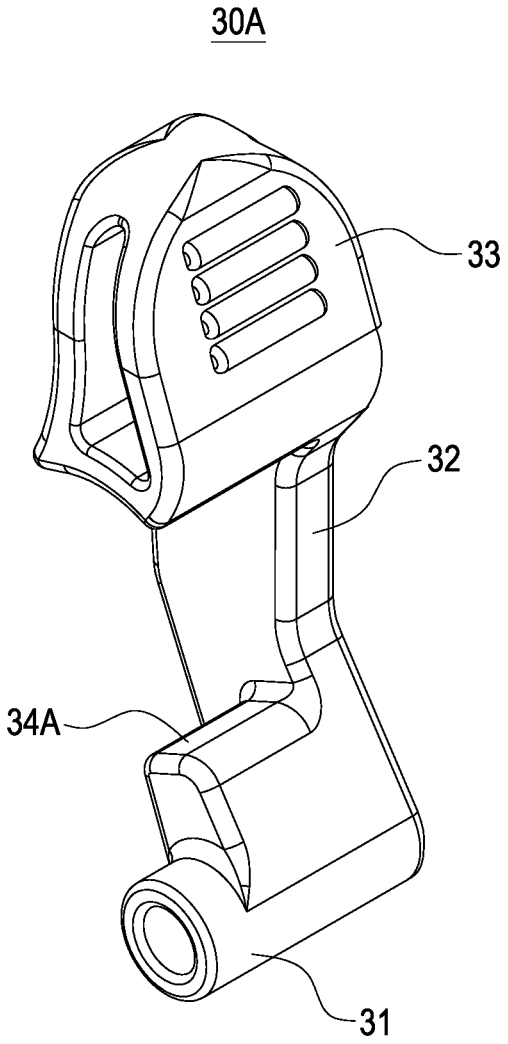
FIG. 8 is a perspective view of another embodiment of the pressing element of the invention.
Figure 9:
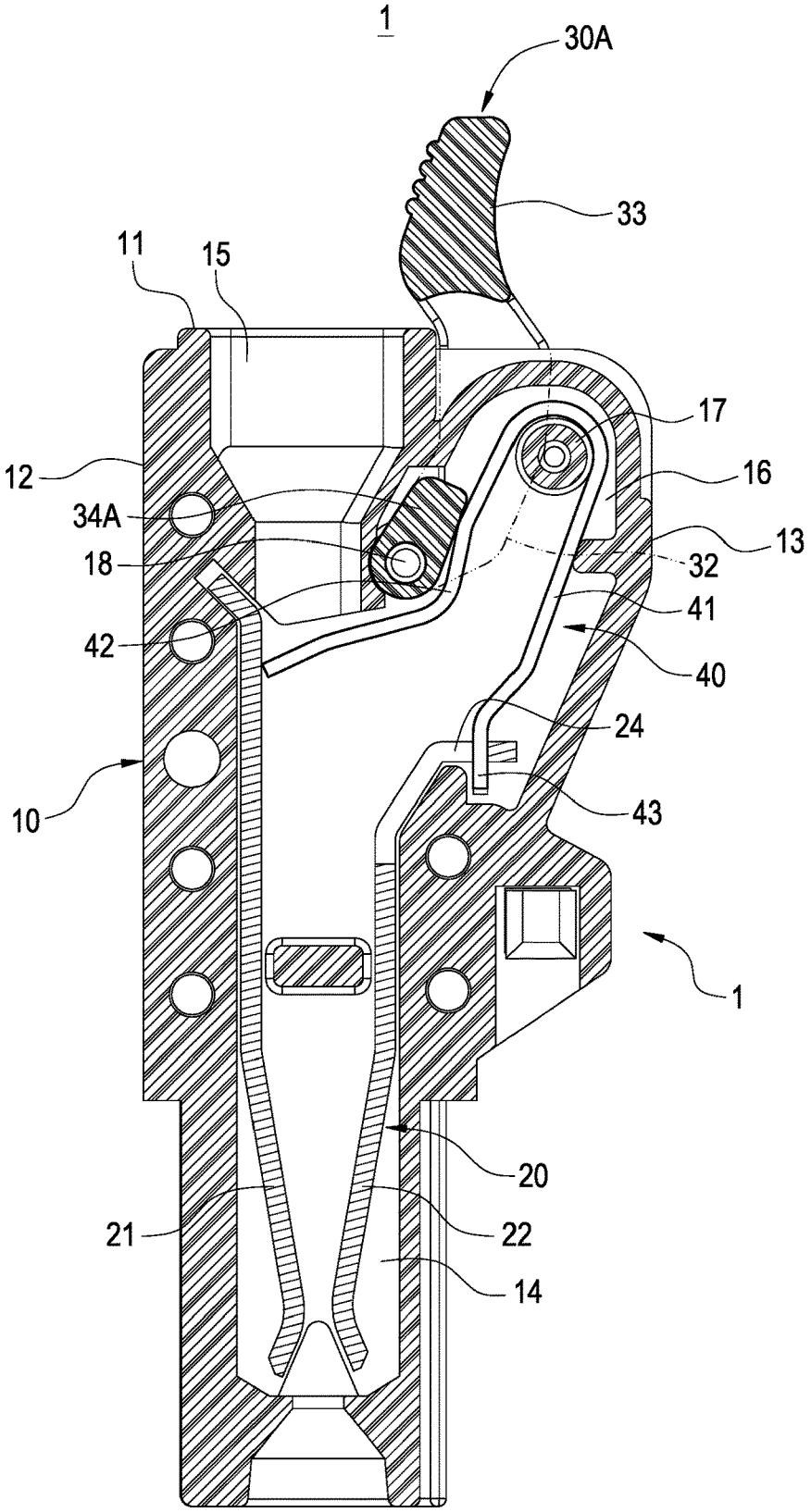
FIG. 9 is a cross-section view of another embodiment of the terminal block structure of the invention.

Please refer to FIGS. 8 and 9. The terminal block structure 1 of the invention may have another embodiment besides the above embodiment. In this embodiment, the pressing portion 34A of the pressing element 30A extends from the pivoting portion 31 along the direction of the arm 32. The pressing portion 34A is substantially a cuboid shape. When the handle 33 is near the wire insertion hole 15, the pressing portion 34A abuts against the moving section 42.

Figure 10:
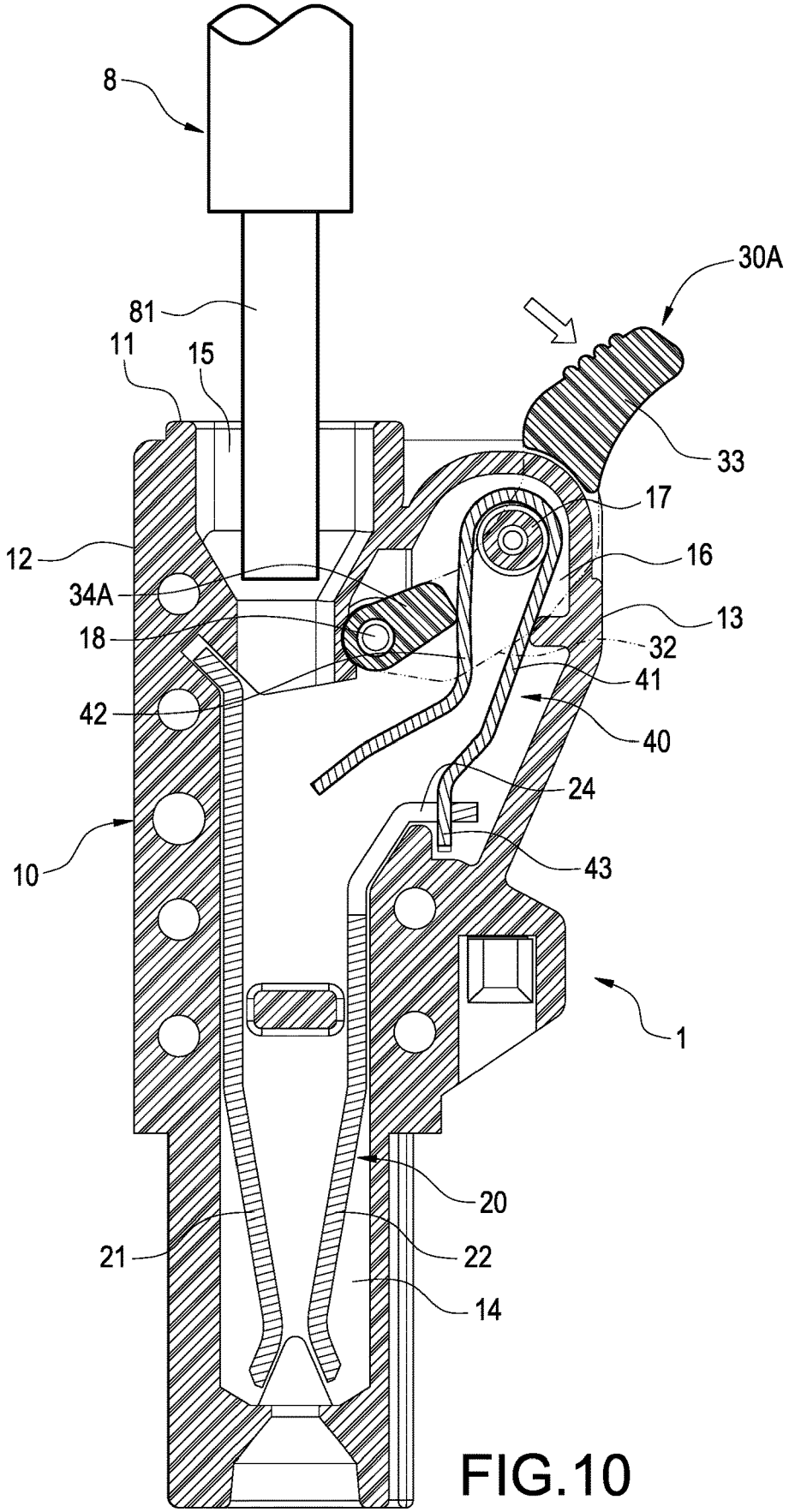
FIG. 10 is a schematic cross-section view of use status of another embodiment of the terminal block structure of the invention and a wire.
Figure 11:
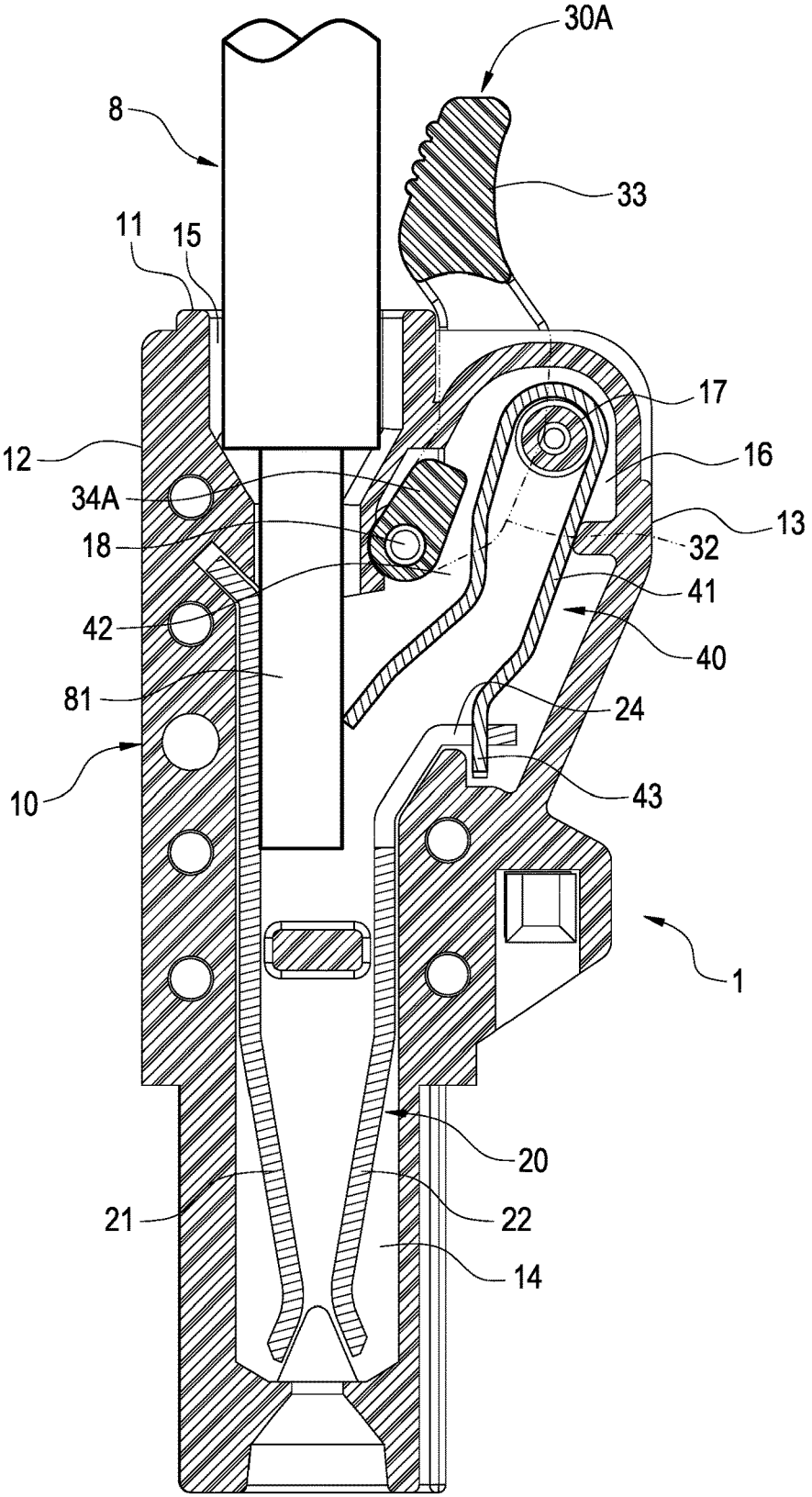
FIG. 11 is another schematic cross-section view of use status of another embodiment of the terminal block structure of the invention and a wire.

Please refer to FIGS. 10 and 11. When using the terminal block structure 1, the handle 33 is pressed in the direction away from the wire insertion hole 15, the pressing portion 34A presses the moving section 42 of the clamping elastic piece 40 to move away from the wire insertion hole 15. At this time, the wire 8 may be inserted into the wire insertion hole 15, and the handle 33 is pressed in a direction toward the wire insertion hole 15. The pressing portion 34A releases the moving section 42 of the clamping elastic piece 40. The moving section 42 and the first conductive sheet 21 jointly clamp the core 81 through the elastic restoring force of the moving section 42. The same effect as the above embodiment may be achieved.

It will be appreciated by persons skilled in the art that the above embodiments have been described by way of example only and not in any limitative sense, and that various alterations and modifications are possible without departure from the scope of the invention as defined by the appended claims.

What is claimed is:

1. A terminal block structure, comprising:

an insulative base, comprising a first side, the insulative base further comprising a chamber, a wire insertion hole communicating with the chamber and an open trough, the open trough and the wire insertion hole both being disposed on the first side;

a conductive terminal, fixed in the chamber and arranged correspondingly to the wire insertion hole;

a pressing element, comprising a pivoting portion, an arm extending from the pivoting portion, a handle extending from the arm and a pressing portion, the pivoting portion being pivotally connected to the insulative base, the arm protruding from the insulative base through the open trough, the handle being disposed on outside of the insulative base and only movable above an extension line of the first side; and a clamping elastic piece, disposed in the chamber and an end of the clamping elastic piece being operatively moved to inside or outside of the wire insertion hole through the pressing portion.

2. The terminal block structure of claim 1, wherein the pressing portion extends from the pivoting portion in a direction away from the arm, and the pressing portion is disposed on a side of the end of the clamping elastic piece.

3. The terminal block structure of claim 1, wherein the pressing portion extends from the pivoting portion in a direction along the arm, and the pressing portion is disposed on a side of the end of the clamping elastic piece.

4. The terminal block structure of claim 1, further comprising: a cover, covering a side of the insulative base.

5. The terminal block structure of claim 4, wherein the cover comprises a shaft and a pressing block, the shaft is correspondingly inserted into the pivoting portion, and the pressing block is pressed to the conductive terminal.

6. The terminal block structure of claim 5, wherein the insulative base comprises multiple fixing bars protruded thereon, the cover comprises multiple through holes, and each of the through holes is correspondingly inserted by each of the fixing bars.

7. The terminal block structure of claim 1, wherein the chamber comprises a pivot, the pivoting portion comprises a shaft sleeve, and the shaft sleeve is inserted by the pivot.

8. The terminal block structure of claim 1, wherein the chamber comprises a pillar, the clamping elastic piece comprises a fixed section and a moving section extending from the fixed section, the fixed portion is fixed between the pillar and a wall of the insulative base, and the moving section extends from the pillar to abut against a periphery of the pressing portion and to reach the wire insertion hole to abut against the conductive terminal.

9. The terminal block structure of claim 8, wherein the conductive terminal comprises a first conductive sheet, a second conductive sheet arranged spacedly with the first conductive sheet and a connecting sheet connected with the first conductive sheet and the second conductive sheet.

10. The terminal block structure of claim 9, wherein the fixed section comprises a clipping piece, the second conductive sheet comprises a slot, and the clipping piece is inserted into the slot.

* * * * *